United States Patent [19]

Lemieux

[11] Patent Number: 4,993,083

[45] Date of Patent: Feb. 19, 1991

[54] VENTILATED TOILET

[76] Inventor: Charles E. Lemieux, 1117, des Escoumins, Lachenaie, Quebec J6W 3T8, Canada

[21] Appl. No.: 539,147

[22] Filed: Jun. 18, 1990

[51] Int. Cl.[5] ..... E03D 9/04

[52] U.S. Cl. ..... 4/213; 4/216; 4/218

[58] Field of Search ..... 4/213, 209, 211, 216, 4/217, 218, 219

[56] References Cited

U.S. PATENT DOCUMENTS

| | | | |
|---|---|---|---|
| 1,972,774 | 9/1934 | Hartwell | 4/213 |
| 2,041,962 | 5/1936 | Robertson | 4/213 |
| 2,329,221 | 9/1943 | Sanford | 4/213 |
| 2,575,778 | 11/1951 | Wilson | 4/213 |
| 2,619,655 | 12/1952 | Huff | 4/213 |
| 2,847,682 | 8/1958 | Shay | 4/213 |
| 3,120,006 | 2/1964 | Knappe | 4/213 |

*Primary Examiner*—Henry K. Artis

*Attorney, Agent, or Firm*—Roland L. Morneau

[57] ABSTRACT

A self-ventilating toilet is provided with an air intake chamber superposed above a water discharge chamber. A tubular member leading to the water discharge is vertically disposed and extends through the air intake chamber and is provided with apertures to allow the water flowing in the tubular member to flow through the air intake chamber and clean the latter.

5 Claims, 2 Drawing Sheets

VENTILATED TOILET

CROSS-REFERENCE TO RELATED APPLICATIONS

U.S. application Ser. No. 454,925, filed Dec. 11, 1989.

BACKGROUND OF THE INVENTION

1. Field of the invention

This invention relates to ventilated toilets and more particularly to means for cleaning the air intake duct adjacent the toilet bowl. The air intake duct adjacent the bowl is susceptible of receiving solid particles form the flushed water in the bowl during the normal operation of the latter and more particularly when an overflow occurs in the bowl.

2. Description of the Prior Art

This application is an improvement over co-pending application No. 454,925 filed on Dec. 11, 1989. This application does not foresee any means for cleaning the air intake duct through which solid particles, floating on the flushed water can enter.

No known ventilated toilet has been found which includes a device or a system for automatically and regularly cleaning the air intake duct, whether it is of the design contemplated in the above-mentioned application or of other design.

SUMMARY OF THE INVENTION

The invention is directed to a self-ventilating toilet which has an air intake chamber leading to a suction device wherein the air intake chamber is regularly cleaned every time the toilet is flushed. In the toilet, according to the present invention, the water outlet passage which extends from the water tank to a water cavity in the toilet bowl has a vertical tubular member surrounded by the air intake chamber which is cleaned by water flowing through apertures in the vertical tubular member of the water discharge passage.

The ventilating chamber in the present invention is provided with a partition elevated above the highest level of the toilet bowl for preventing the water flowing from the apertures in the direction of the ventilating chamber.

DETAILED DESCRIPTION OF THE INVENTION

Figure 1:
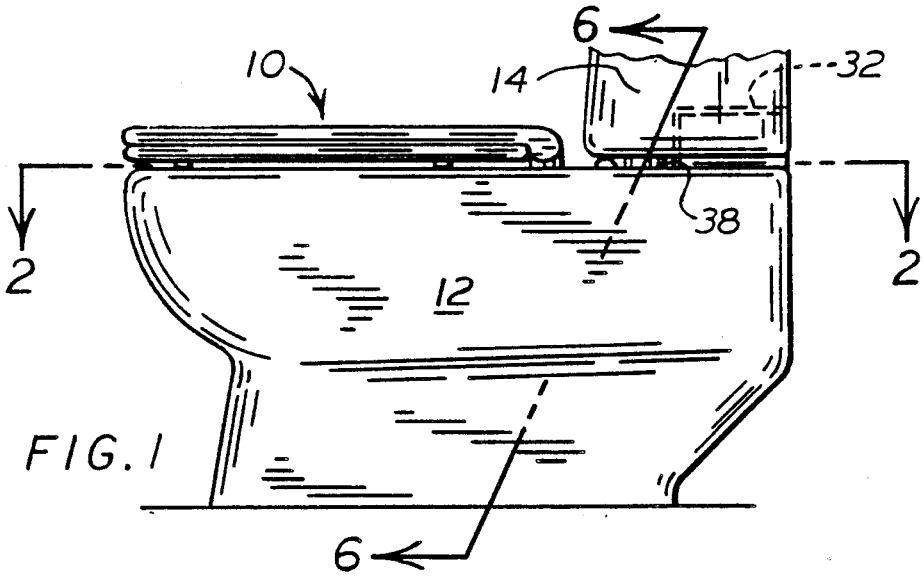
FIG. 1 is a side view of a toilet bowl suitable for the invention.
Figure 2:
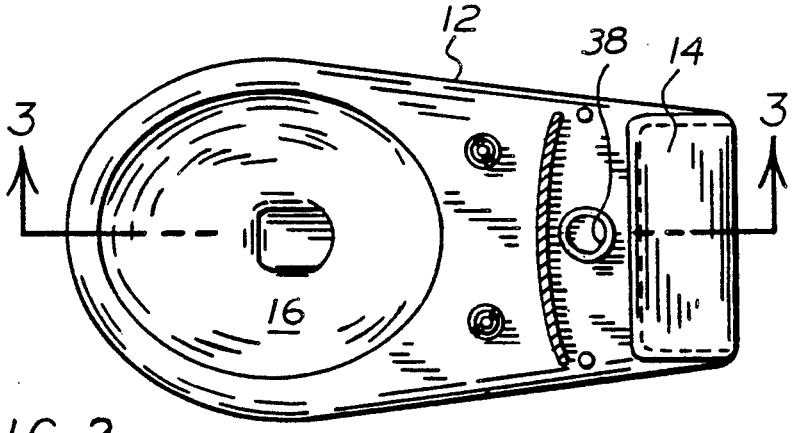
FIG. 2 is a horizontal cross-sectional view along line 2—2 of FIG. 1.

FIG. 1 illustrates an embodiment of a self-ventilating toilet 10 including a bowl 12, a water tank 14 adapted to contain flushing water. A water outlet passage extends from the water tank 14 towards a cavity 16 located in the bowl 12. When the water is flushed from the tank 14 towards the cavity 16, the level of the water 18 raises in the cavity 16 and is expelled through the flushing aperture 20 in the direction of the discharge passage 22 and towards the lower outlet 24 of the toilet 10. Behind the discharge passage 22 is located a ventilating chamber 26 containing a suction device 28 adapted to suck the air from the cavity 16 through an air intake chamber extending between the cavity 16 and the ventilating chamber 26.

The ventilating chamber 26 has a protuberant portion which extends above the highest level 31 of the cavity 16. According to the embodiment illustrated, the protuberant portion 30 exceeds mainly above the ventilating chamber 26 and provides a seat for the water tank 14 which has a bottom surface along two distinct levels 32 and 34. The lower level 34 is provided with an aperture 36 which can be releasably blocked by a conventional plunger (not shown).

Figure 3:
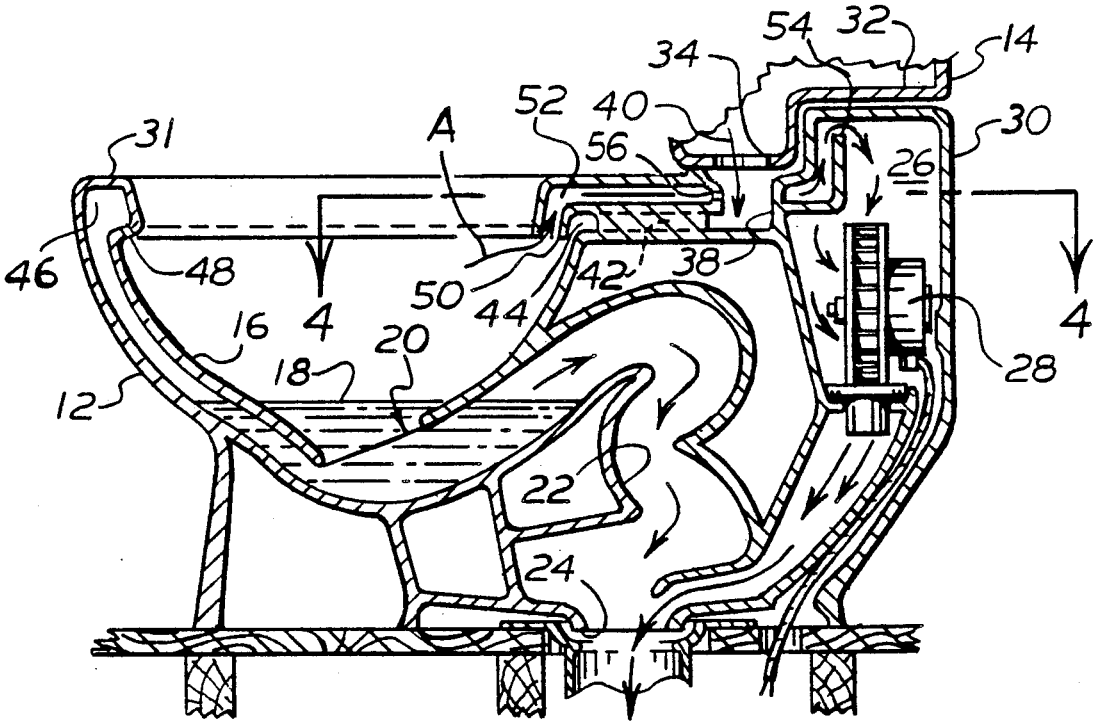
FIG. 3 is a vertical cross-sectional view of the bowl along line 3—3 of FIG. 2.

When the plunger is removed from the aperture 36, the water flows down the pipe 38 in the direction of the arrow 40. The water then flows through a horizontal channel 42 in the direction of the arrow 43 through an exit slot 44. The water is usually flushed at such a speed that the size of the slot is not sufficient to let all the water exit therethrough. Some of the flushed water circulates around the hollow ring 46 and through small holes 48 to supply water to the cavity 16 and which simultaneously cleans the surface of the cavity. The end of the channel 42 which exits inside the cavity 16 is provided with a lip 50 (FIG. 3) adjacent the cavity 16 so as to define the downward slot 44 which prevents solid particles from moving up towards and into the horizontal channel 42.

Figure 6:
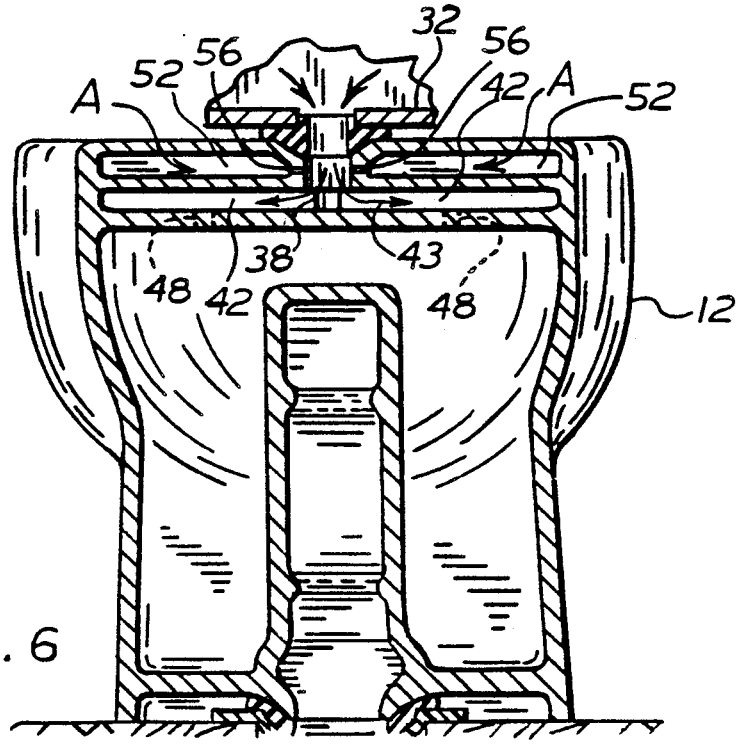
FIG. 6 is a cross-sectional view along line 6—6 of FIG. 1.
Figure 4:
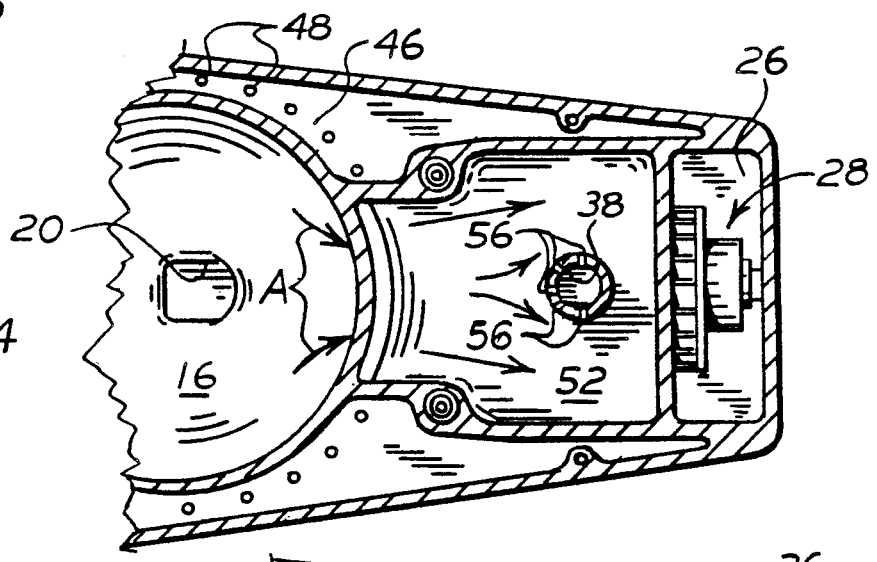
FIG. 4 is a horizontal cross-sectional view along line 4—4 of FIG. 3.
Figure 5:
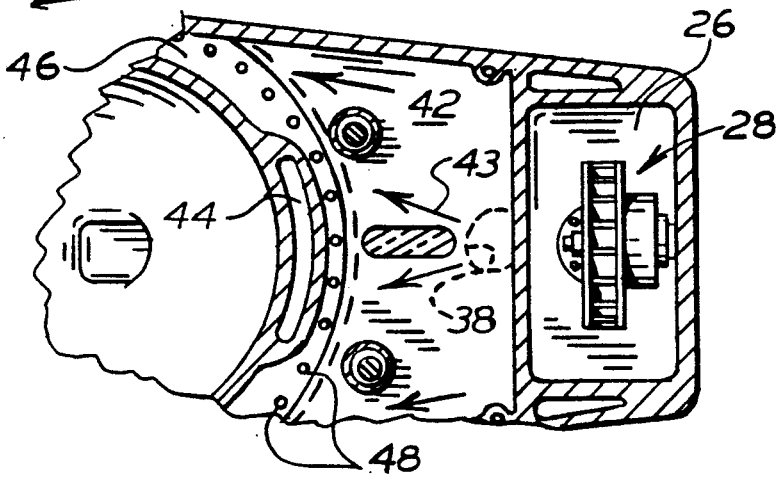
FIG. 5 is a horizontal cross-sectional view along a line parallel and slightly below line 4—4 through a horizontal channel of a water outlet passage.

The air which is sucked by the suction device 28 comes from the cavity 16 in the direction of the arrow A, follows the air intake chamber 52 which is superposed above the horizontal channel 42, passes around the pipe 38 before entering the ventilating chamber 26. While entering the ventilating chamber 26, the air is directed upwardly by a vertical partition 54 forming a duct 55 which forces the air to move inside and towards the upper part of the protuberant portion 30. The upper lip of the vertical partition 54 is at a level above the top of the hollow ring 31. The height of the partition 54 relative to the height 31 prevents any overflow of water in the cavity 16 to move towards the ventilating chamber 26. As it can be particularly seen in FIGS. 4 and 6 coming from the slot 44 flowing towards the air intake chamber 52 located above the horizontal channel 42, passes around the pipe 38 before it enters the ventilating chamber 26. The pipe 38 is between the bowl 12 and the ventilating chamber 26. Under normal conditions, the air which enters the air intake chamber 52 in the direction of the arrow A brings dirt and dust inside the air intake chamber 52 and may even be soiled by other solid particles if there is an overflow of water in the cavity 16. In order to keep the air intake chamber 52 free of dust, dirt and any other solid material coming from the cavity 16, it is a characteristic of the invention to provide the pipe 38 with apertures 56 located at the level of the air chamber 52. Whenever the water is flushed from the tank 14, the water passes through the pipe 38 to mainly be directed in the direction of the exit slot 44 and through the holes 48. However, a small amount, depending on the relative small size of the apertures 56 will flow through the air intake chamber 52. The amount of water flowing through the apertures 56 is minimal and do not restrict substantially the flow of air coming in the opposite direction. The water passing through the air intake chamber 52 is sufficient to maintain the latter chamber clean considering that this operation takes place every time the toilet is flushed.

This cleaning operation is automatic and frequently repeated without any manual intervention. This operation is made possible by the particular construction of the air intake chamber relative to the horizontal channel letting the water circulate at a lower level than the air chamber and accordingly, allowing the pipe 38, in which the water flows to allow part of said water to flow through the air intake chamber every time the water is flushed in the toilet.

The present invention has been described with a toilet bowl having a water tank mounted over it. The invention also applies to public toilets where flushing water is received from a water supply using a piping system leading to the toilet bowl and in particular to the vertical tubular member 38.

What is claimed is:

1. In a self-ventilating toilet adapted to store flushing water received from a water supply, a bowl having a cavity adapted to retain a portion of said flushing water, a water outlet passage extending in said bowl for allowing a flow of flushing water from said water supply to said cavity in said bowl, said passage having a vertical tubular member extending above said bowl and a horizontal channel leading from said tubular member to said cavity;

an air intake chamber extending between said cavity and an air suction device for sucking air from said cavity, said air intake chamber horizontally extending above said horizontal channel and surrounding said tubular member, said tubular member being provided with small apertures for supplying small amount of flushing water to said air intake chamber, and stop means for preventing said small amount of water to flow in the direction of the suction device.

2. A self-ventilating toilet as recited in claim 1, wherein said air intake chamber projects downwardly into in said cavity as a narrow opening to thereby prevent solid particles larger than said opening from flowing in the direction of said horizontal air intake chamber.

3. A self-ventilating toilet as recited in claim 2, wherein said toilet has a ventilating chamber located away from said bowl relative to said vertical tubular member, said ventilating chamber having a protuberant portion projecting above the level of said horizontal air intake chamber, duct means for guiding air from said intake chamber to said protuberant portion, the height of the level of said duct means adapted to prevent any overflow of flushing water in said cavity to reach said ventilating chamber.

4. A self-ventilating toilet as recited in claim 3, comprising a water tank located above said bowl for supplying said flushing water, said tubular member extending from said tank to said horizontal channel.

5. A self-ventilating toilet as recited in claim 4, wherein said ventilating chamber is located below a part of said water tank.

* * * * *